US007507936B2

(12) United States Patent
Mast et al.

(10) Patent No.: US 7,507,936 B2
(45) Date of Patent: Mar. 24, 2009

(54) WAX STICK SCRAPER

(75) Inventors: Frank Mast, Petersburg, VA (US); Joy McCann-Ellis, Creedmoor, NC (US)

(73) Assignee: Mastex Industries, Inc., Petersburg, VA (US)

( * ) Notice: Subject to any disclaimer, the term of this patent is extended or adjusted under 35 U.S.C. 154(b) by 330 days.

(21) Appl. No.: 11/480,673

(22) Filed: Jul. 3, 2006

(65) Prior Publication Data

US 2006/0243296 A1 Nov. 2, 2006

(51) Int. Cl.

| | |
|---|---|
| ***A45D 26/00*** | (2006.01) |
| ***A45D 40/00*** | (2006.01) |
| ***A45D 40/26*** | (2006.01) |
| ***F27B 14/00*** | (2006.01) |
| ***B65D 25/20*** | (2006.01) |

(52) U.S. Cl. ..... 219/429; 219/201; 219/214; 15/236.01; 15/236.09; 220/695; 220/700

(58) Field of Classification Search ..... None
See application file for complete search history.

(56) References Cited

U.S. PATENT DOCUMENTS

| | | | | |
|---|---|---|---|---|
| 2,646,193 | A * | 7/1953 | Best | 220/701 |
| 3,133,668 | A | 5/1964 | Heise | |
| 3,688,943 | A | 9/1972 | Brown | |
| 3,894,650 | A * | 7/1975 | Crump | 220/701 |
| 4,009,802 | A | 3/1977 | Hayduchok | |
| 4,203,537 | A | 5/1980 | McAlister | |
| 4,890,807 | A | 1/1990 | Desjardins | |
| 4,969,617 | A * | 11/1990 | Desjardins | 220/697 |
| D329,576 | S | 9/1992 | Desjardin | |
| D345,833 | S | 4/1994 | Truran | |
| 5,687,873 | A | 11/1997 | Jones | |
| D459,848 | S * | 7/2002 | Anderson | D32/54 |
| 6,446,829 | B1 | 9/2002 | Malvasio | |
| D475,827 | S * | 6/2003 | McIntee | D32/54 |
| 6,616,110 | B1 * | 9/2003 | McIntee | 220/697 |

* cited by examiner

*Primary Examiner*—Joseph M Pelham
(74) *Attorney, Agent, or Firm*—Andrew Wilford

(57) ABSTRACT

A wax applicator stick scraper according to the invention can be fitted onto the top edge of a disposable wax can received in a wax heater and can have a quarter-moon shape with a free edge with rectilinear segments of different lengths and different angles between them to accommodate different widths and shapes of the applicator stick.

8 Claims, 2 Drawing Sheets

WAX STICK SCRAPER

FIELD OF THE INVENTION

My present invention relates to a wax stick scraper, in particular, for scraping wax, and especially excess wax from a stick used in applying wax to the skin for wax treatment and/or dipilation.

BACKGROUND OF THE INVENTION

In the application of wax to the skin to be treated, use is made of an applicator in the form of a stick. The latter can be inserted into a bath of hot wax in a wax heater, withdrawn from the bath with adherent molten wax and applied to the skin. The removal of excess wax from the applicator or stick is frequently important and sticks of various width may be used in the application process.

If the stick is wiped along the edge of a can containing the wax and inserted into a wax heater closely surrounding the can, both the edge of the can and the surrounding heater may become contaminated with the wax and have to be cleaned at the end of the process. Furthermore, the wiping or scraping of the stick along a rounded lip of the can may not remove all or as much of the wax from the stick as may be required or desired and cannot ensure a uniform thickness of the layer of wax across the width of the stick.

Indeed, problems of the removal of excess liquid from applicators for liquids, such as paint brushes, have been dealt with in the past by, for example, mounting a paint scraper or wiper on the lip of a paint can. The wiping edge may then lie inwardly of the lip of the can so that the excess paint or the paint wiped from the brush can fall directly back into the body of liquid in the can and will not contaminate the lip of the can.

While such wiping devices have proved to be effective for paint, they have not been found to be effective or sufficiently versatile as wax scrapers in the dipilatory field or for use of hot wax for treatment of a subject.

OBJECTS OF THE INVENTION

It is, therefore, the principal object of the present invention to provide a wax stick scraper which will eliminate the problems enumerated above and satisfy the requirements of uniform. thickness, complete removal and the like for a variety of wax applicator sticks of different widths.

It is also an object of the invention to provide a wax stick scraper of high versatility for use with wax cans in wax heaters, whereby drawbacks in wax stick scraping can be avoided.

Another object of this invention is to provide an improved assembly for wax application.

SUMMARY OF THE INVENTION

These objects and others are achieved, in accordance with the invention in a wax stick scraper for a wax can having an upper edge and receivable in a wax heater. The scraper comprises:

a one-piece body formed with an arcuate flange extending over an arc of the can and provided with a channel receiving a portion of the can edge over the arc, whereby the body is supported on the can;

a web extending inwardly from the body and formed over an interior of the can with a free edge between opposite ends of the flange, the free edge having a plurality of angularly adjoining rectilinear segments of different length adapted to accommodate different wax stick widths.

According to the invention the web is planar and lies in a plane parallel to a plane of the upper edge. The body can generally be of the shape of a quarter moon.

The channel can be defined between inner and outer walls receiving an upper edge between them, one of the walls having a bead projecting toward the other wall for engaging the can. The can can have an outer peripheral recess into which the bead projects. The segments along the free edge of the web can include a long segment at the center for the widest of applicator sticks. One or more shorter segments to either side thereof and even a V-shaped segment to one side of the longer segment. The web can be braced from underneath by struts extending upwardly from the lower edge of the flange to the free edge of the web. The invention also applies to an assembly or waxing apparatus comprised of the heater, a wax can removably received in the heater and the scraper.

The scraper of the invention saves time in applying the wax, saves wax and is far cleaner in use than previous systems.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
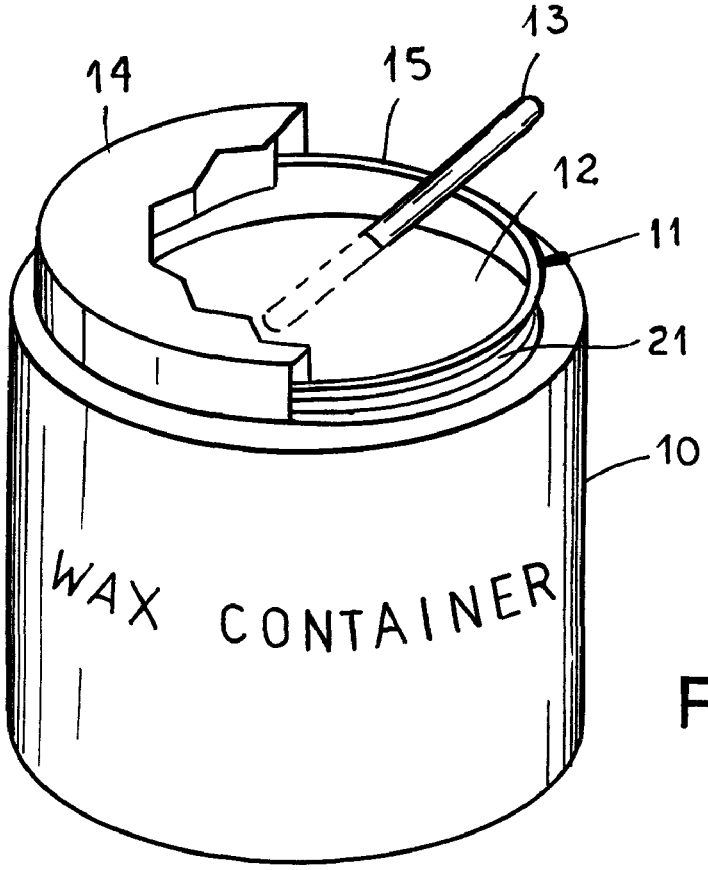
FIG. 1 is a perspective view in somewhat diagrammatic form of an apparatus for waxing in accordance with the invention.

In FIG. 1 I have shown a wax heater 10 into which a disposable wax can 11 can be inserted so that a wax 12 therein can be heated and applied by an applicator stick 13 to the skin of a user. The excess wax can be scraped from the stick 13 by a scraper 14 which can be fitted over an arc of the peripheral edge 15 of the can 11.

Figure 2:
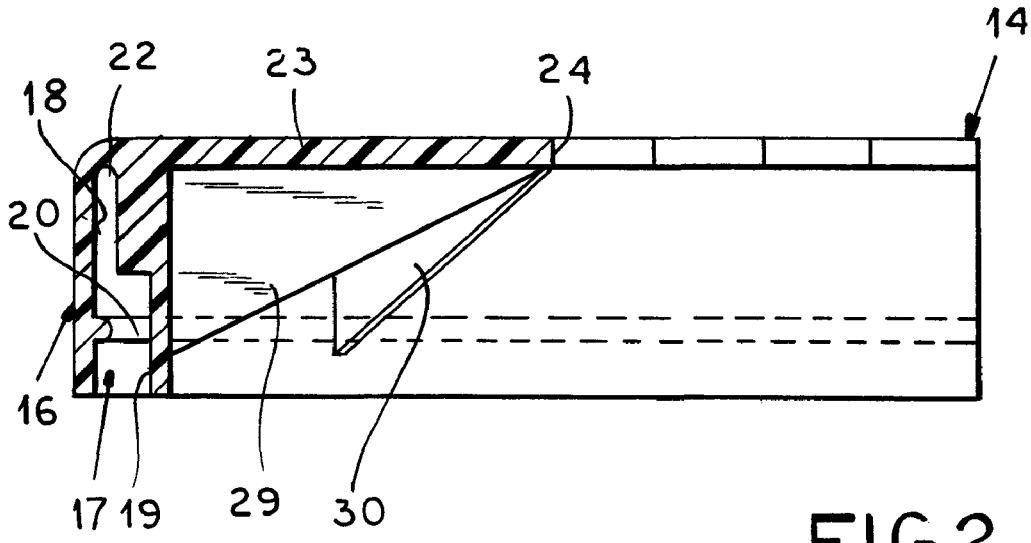
FIG. 2 is a cross sectional view through the scraper seen in FIG. 1.
Figure 4:
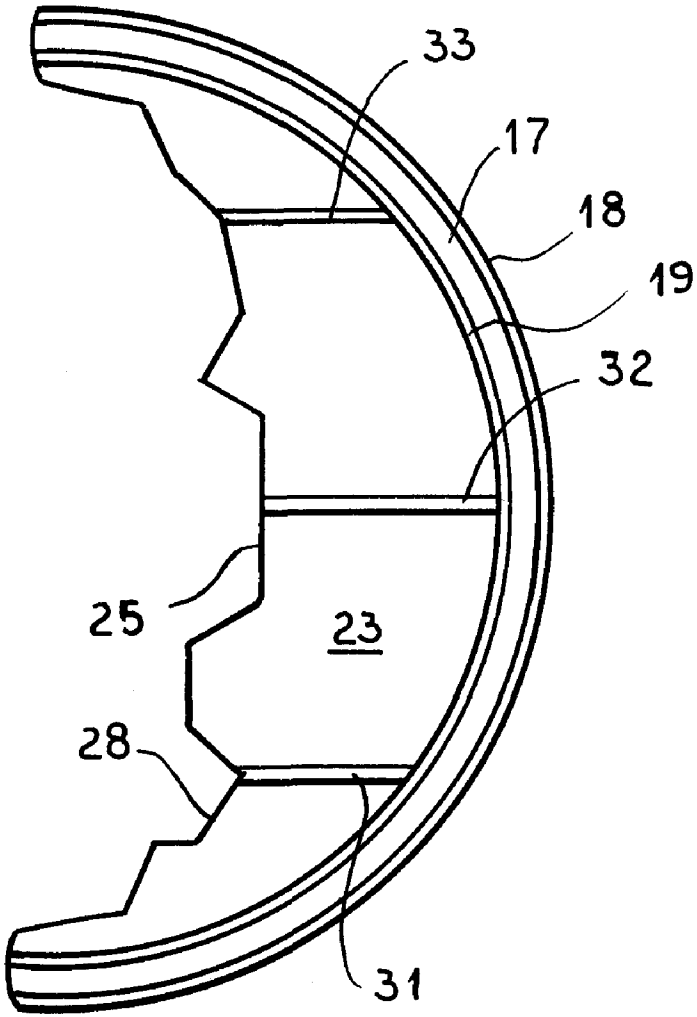
FIG. 4 is a bottom view thereof.
Figure 3:
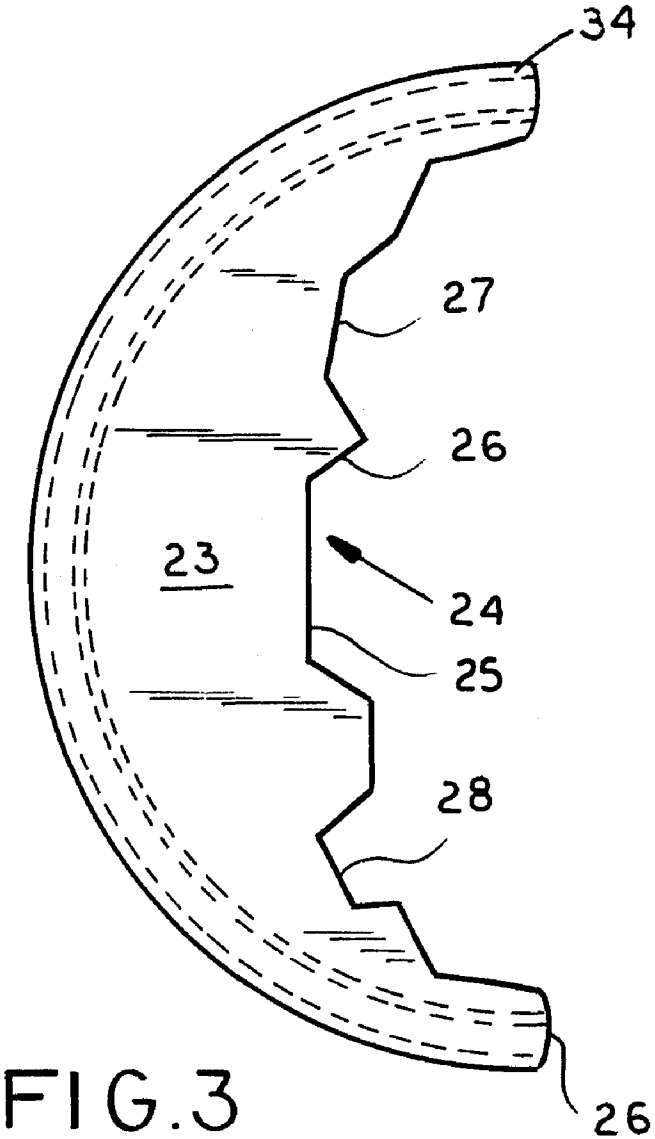
FIG. 3 is a plan view of the scraper.

As can be seen from FIGS. 2-4, for this purpose, the scraper 14 can have an arc segmental flange 16 which is formed with a channel 17 to receive the edge 15. That channel is defined between a heater wall 18 and an inner wall 19, the outer wall having an inwardly projecting leaf 20 which can extend into a peripheral groove 21 in the can 13 or can otherwise bear against the can. To impart elasticity to the outer wall 18, for this purpose, the channel 17 is extended upwardly by a narrow slot 22 terminating close to the top of the flange.

The one-piece body of the injection-molded thermoplastic forming scraper 14 can also be provided with an. inwardly extending web 23 which has a free edge represented generally at 24 extending from one end 25 to the diametrically opposite end 26 of the flange. The free edge 24 has a plurality of angularly adjoining rectilinear segments 25, 26, 27 and 28, for example, to accommodate different shapes and widths of the applicator sticks which are wiped against these segments.

For example, there can be a relatively long segment 25 at the center to accommodate the widest applicator sticks, shorter segments 27 and 28 on opposite sides of the long segment 25 to accommodate narrower sticks and a V-shaped segment 26, for example, to accommodate a V section stick.

The web 23 can be supported on its underside by struts 29 and 30 reaching from the bottom of the flange 16 to the free edge 24. These struts may be radial as shown in FIG. 2. Alternatively, parallel struts may be provided along chords as shown at 31, 32 and 33 in FIG. 4, if desired.

We claim:

1. A wax treatment apparatus comprising:

a wax heater;

a wax can receivable in said heater and having an open edge; and a wax stick scraper fitted onto said can and comprising:

a one-piece body formed with an arcuate flange extending over an arc of said can and provided with a channel receiving a portion of said edge over said arc, whereby said body is supported on said can; and a web extending inwardly from said body and formed over an interior of said can with a free edge between opposite ends of said flange, said free edge having a plurality of angularly adjoining rectilinear segments of different length adapted to accommodate different wax stick widths.

2. The wax treatment apparatus defined in claim 1 wherein said web of planar and lies in a plane parallel to a plane of said upper edge.

3. The wax treatment apparatus defined in claim 1 wherein said body is generally of the shape of a quarter moon.

4. The wax treatment apparatus defined in claim 3 wherein said channel is defined between outer and inner walls receiving said upper edge between them.

5. The wax treatment apparatus defined in claim 4 wherein one of said walls has a bead projecting toward the other of said walls for engaging said can.

6. The wax treatment apparatus defined in claim 5 wherein said bead is on said outer wall.

7. The wax treatment apparatus defined in claim 6 wherein said segments include a long segment at a center of said edge and shorter segments on opposite sides of the long segment.

8. The wax treatment apparatus defined in claim 7, further comprising struts on an underside of said body spaced around said flange.

* * * * *